US005785424A

United States Patent [19]

Noda et al.

[11] Patent Number: 5,785,424

[45] Date of Patent: Jul. 28, 1998

[54] AGITATOR BLADE HAVING AGITATORS WITH OPEN FIRST AND SECOND ENDS AND INNER FABRICS THEREIN

[75] Inventors: Yasuo Noda; Hideo Noda, both of Amagasaki; Takaya Inoue, Takatsuki, all of Japan

[73] Assignee: Kansai Chemical Engineering Co. Ltd., Amagasaki, Japan

[21] Appl. No.: 577,974

[22] Filed: Dec. 22, 1995

Related U.S. Application Data

[60] Continuation-in-part of Ser. No. 399,178, Mar. 6, 1995, abandoned, which is a division of Ser. No. 233,047, Apr. 25, 1994, abandoned.

[30] Foreign Application Priority Data

Apr. 30, 1993 [JP] Japan ..... 5-124843
Oct. 21, 1993 [JP] Japan ..... 5-285653

[51] Int. Cl.[6] ..... B01F 7/26

[52] U.S. Cl. ..... 366/317; 366/325.1; 366/326.1; 416/231 A

[58] Field of Search ..... 366/315, 317, 366/262–265, 270, 279, 292, 325.1, 326.1, 328.1, 328.2, 328.3, 328.4, 329.1, 329.2, 331, 330.1, 336–340, 342, 343, 349; 416/231 A; 261/91, 93

[56] References Cited

U.S. PATENT DOCUMENTS

| | | | |
|---|---|---|---|
| 8,596 | 12/1851 | Skinner | 366/263 |
| 38,891 | 6/1863 | Emerson | 366/262 X |
| 469,058 | 2/1892 | Currier | 366/263 X |
| 873,131 | 12/1907 | Leiser | 366/265 |
| 979,510 | 12/1910 | Keller | 366/265 |
| 2,106,529 | 1/1938 | Keller | 366/314 X |
| 2,143,652 | 1/1939 | Gaertner . | |
| 2,800,315 | 7/1957 | Griesbach | 261/93 X |
| 3,704,009 | 11/1972 | Kalbskopf | 261/91 |
| 3,861,652 | 1/1975 | Clark et al. | 366/336 |
| 3,911,065 | 10/1975 | Martin et al. | 261/91 |
| 3,944,119 | 3/1976 | Egee | 366/136 X |
| 4,040,256 | 8/1977 | Bosche et al. | 366/337 X |
| 4,207,202 | 6/1980 | Cole, Jr. | 366/337 X |
| 4,310,437 | 1/1982 | Schreiber | 261/91 X |
| 4,511,258 | 4/1985 | Federighi et al | 366/337 |
| 4,533,015 | 8/1985 | Kojima | 366/339 X |
| 5,104,233 | 4/1992 | Kojima | 366/339 |

FOREIGN PATENT DOCUMENTS

| | | | |
|---|---|---|---|
| 166479 | 9/1954 | Australia | 261/91 |
| 0000293 | 7/1978 | European Pat. Off. . | |
| 63318 | 9/1955 | France | 261/91 |
| 72132 | 7/1957 | France . | |
| 2009464 | 5/1969 | France . | |
| 2129529 | 2/1972 | France . | |
| 2482470 | 4/1980 | France . | |
| 2626787 | 2/1989 | France . | |
| 185488 | 11/1905 | Germany . | |
| 1609032 | 6/1966 | Germany . | |
| 1658067 | 10/1967 | Germany . | |
| 1658115 | 11/1967 | Germany . | |

(List continued on next page.)

*Primary Examiner*—Charles E. Cooley
*Attorney, Agent, or Firm*—Darby & Darby

[57] ABSTRACT

An agitator blade comprises one or more cylindrical local agitators which have inner fabrics therein and are radially mounted on a mounting frame, which in turn is secured to an agitator shaft. The inner fabrics can include, for example, one or more twisted plates, one or more orifice plates, a plurality of bent plates, which are disposed in an alternately inverted relationship with one another so that the facing bent peripheral side of the adjacent bent plates cross each other, a plurality of flat plates or one or more net-like sheets. The agitator shaft is rotated by a motor to drive the local agitators to mix the fluid throughly. When applied for agitation and mixing processes, the agitator blade of this invention can realize a high degree of mixing easily and reliably in a short period of time and with a small driving power. Further, the construction of this agitator blade is simple.

9 Claims, 9 Drawing Sheets

FOREIGN PATENT DOCUMENTS

| | | | |
|---|---|---|---|
| 1941146 | 8/1969 | Germany . | |
| 1963614 | 12/1969 | Germany . | |
| 1964125 | 12/1969 | Germany . | |
| 2418679 | 4/1974 | Germany . | |
| 2844038 | 10/1978 | Germany . | |
| 2923375 | 6/1979 | Germany . | |
| 8528381.9 | 10/1985 | Germany . | |
| 54-27160 | 9/1979 | Japan . | |
| 56-21635 | 2/1981 | Japan . | |
| 58-40203 | 3/1983 | Japan . | |
| 60-64621 | 4/1985 | Japan . | |
| 60-83038 | 6/1985 | Japan . | |
| 372933 | 3/1991 | Japan . | |
| 248204 | 4/1947 | Switzerland | 366/168 |
| 310669 | 12/1971 | U.S.S.R. | 366/329 |
| 562303 | 6/1977 | U.S.S.R. | 366/279 |
| 1005870 | 2/1981 | U.S.S.R. . | |
| 914077 | 3/1982 | U.S.S.R. . | |
| 1095973 | 11/1982 | U.S.S.R. . | |
| 997774 | 2/1983 | U.S.S.R. | 366/292 |
| 1278010 | 2/1985 | U.S.S.R. . | |
| 1178609 | 9/1985 | U.S.S.R. | 366/349 |
| 1542601 | 2/1990 | U.S.S.R. | 366/279 |
| 127705 | 6/1919 | United Kingdom | 261/91 |
| 401583 | 4/1933 | United Kingdom . | |
| 749327 | 12/1953 | United Kingdom . | |
| 8103129 | 11/1981 | WIPO | 366/336 |

AGITATOR BLADE HAVING AGITATORS WITH OPEN FIRST AND SECOND ENDS AND INNER FABRICS THEREIN

This is a continuation-in-part application of U.S. patent application Ser. No. 08/399,178 filed Mar. 6, 1995, now abandoned which is a divisional of U.S. patent application Ser. No. 08/233,047 filed Apr. 25, 1994, which is now abandoned.

BACKGROUND OF THE INVENTION

1. Field of the Invention

The present invention relates to an agitator blade and more particularly to an agitator blade which is capable of mixing fluid efficiently and reliably.

2. Description of the Prior Art

Among widely used agitator blades are turbine blades, oar blades, marine blades and ribbon blades. When these conventional agitator blades are used for agitating and mixing within small-scale equipment or tanks, a high degree of mixing can be reached in a relatively short time without trouble, even with a single agitator blade.

When such agitator blades are used in large-scale tanks in plants, however, the use of only one agitator blade may result in an unexpected dead space being formed in the tanks, taking a protracted length of time to mix fluid at a sufficiently high degree of mixing. Even after many hours of mixing operation, it is often not possible to achieve a high degree of mixing that is easily realized for small-scale equipment and tanks.

One possible way to cope with such a situation is by increasing the number of agitator blades. There is, however, a limit on the number of agitator blades that can be used in a tank. Even if the number of agitator blades is increased to as many as is allowed in the tank, the degree of mixing does not increase in proportion to an increase in the number of agitator blades. The additional agitator blades on the other hand require additional driving power, significantly increasing the operation cost.

After having conducted research on ways to eliminate aforementioned drawbacks experienced with the conventional agitator blades, the inventors of this invention have developed an agitator blade which is simple in construction and can achieve a high degree of mixing easily and reliably and with a minimum amount of driving power, and which comprises a plurality of local agitators for simultaneous agitation at multiple locations.

SUMMARY OF THE INVENTION

The present invention concerns an agitator blade in which local agitators incorporating inner fabrics therein are mounted to a mounting frame secured to an agitator shaft.

In this invention, the local agitators themselves are not directly driven and require no driving power. The only member that is driven is the agitator shaft. There are no structural limitations except for the following requirement. That is, as the agitator shaft is driven, the mounting frame on which the local agitators are mounted is rotated about the agitator shaft to let fluid to be mixed pass through the local agitators, locally agitating the fluid in the tank. Such local agitators incorporating inner fabrics therein may be used as a flow mixer.

According to the representative aspect of this invention, the local agitator include: a cylinder incorporating inner fabrics, such as one or more twisted plates, one or more orifice plates, a plurality of bent plates which are disposed in an alternately inverted relationship with one another so that the facing bent peripheral sides of the adjacent bent plates cross each other, a plurality of flat plates which are stacked on their peripheral sides so that the facing peripheral sides of the adjacent flat plates cross each other, and one or more net-like sheets so disposed as to cross the longitudinal axis of the cylinder.

The twisted plate may be twisted either in a positive or forward direction, i.e., clockwise as seen from the front end of the twisted plate, or in a reverse direction, i.e., counter-clockwise as seen from the front end of the twisted plate. The twist angle of the twisted plate, i.e., an angle between one end and the other end of the twisted plate, may be set anywhere in the range of 90 to 180 degrees. When a plurality of twisted plates are employed, they are arranged in series end-to-end, with their axes substantially aligned along the longitudinal axis of the cylinder, i.e., the cylinder axis passing through the opposite openings of the cylinder.

There is no restriction on the number of holes formed in the orifice plate. One hole or two or more holes may be provided.

The bent plate may be formed by bending a square or rectangular plate at least once along a distinct bending line near the center, or by curving the plate at least once by bringing the opposite peripheral sides toward each other to cause the central portion of the plate between the opposing peripheral sides to form a vertex or a bottom.

The plurality of bent plates, which are disposed in an alternately inverted relationship with one another so that the facing bent peripheral sides of the adjacent bent plates cross each other, are installed in a rectangular parallelepiped- or a cube-shaped cylinder that circumscribes them. The plurality of bent plates are arranged side by side in the cylinder with their longitudinal axes, i.e., virtually perpendicular to the bending lines, vertices or bottoms, extending substantially parallel to the axis of the cylinder. As a result, the bending lines, vertices or bottoms of the bent plates are placed in contact with the upper and lower internal surfaces, alternately, of the cylinder that circumscribes the bent plates.

The bent plates may have their facing peripheral sides in contact with or spaced from each other.

The flat plates incorporated in the cylinder may include, for example, plates curved with a small curvature and corrugated plates with small pitches in addition to flat plates. Normally, the flat plates are virtually square or rectangular.

The plurality of flat plates are so disposed that their facing peripheral sides cross each other. The flat plates are installed inside a cylinder that inscribes them.

The flat plates may be placed in contact with each other at their facing peripheral sides or spaced from each other.

Among preferable examples of the net-like sheets installed in the cylinder are a wire net, a plastic net or a lamination of these nets.

Inside the cylinder of the local agitator, there is formed a complex fluid passage by the inner fabrics.

The inner surface of the cylinder of the local agitator and the surface of the inner fabrics may be either smooth or rough, or may be formed with small depressions and projections in such patterns as waves, dots or small circles.

The cylinder of the local agitator may take an arbitrary shape as long as it ensures that the inner fabrics can be installed therein and fluid to be mixed can pass through the cylinder. For example, the transverse cross section of the cylinder, i.e., a cross section perpendicular to the axis of the cylinder that normally corresponds to the shape of the openings, may take a polygonal shape such as a triangle, quadrangle, pentagon and hexagon, or a circular shape such as a circle, oval and ellipse, depending on the inner fabrics installed in the cylinder. For example, the transverse cross section of the cylinder is preferably a circle when accommodating the twisted plates. In accommodating the bent plates and flat plates, a square or rectangular transverse cross section is preferred. The cylinder of the local agitator may be formed either as a straight pipe or a curved pipe with a small curvature.

One or more such local agitators are mounted on a mounting frame. The mounting frame may be formed as a flat plate member, a curved plate member, a square rod member, a round rod member, sections, and a structure using these members. The mounting frame is secured to an agitator shaft at its center of rotation or center of the rotating plane. Usually, the agitator shaft is substantially perpendicular to the rotating plane or rotation plane of the mounting frame.

The size and number of the local agitators to be mounted on a single surface or both surfaces of the mounting frame are determined according to varieties and property of fluid to be mixed, the size and shape of the tank, and the target degree of mixing.

A single mounting frame may be mounted with single or a plurality of local agitators.

The plurality of local agitators mounted on one or more mounting frames may employ the same construction or differing constructions.

BRIEF DESCRIPTION OF THE DRAWINGS

FIGS. 1*a* through 1*c* show preferred embodiments of the agitator blade according to this invention, wherein FIG. 1*a* is a perspective view of an agitator blade, FIG. 1*b* is a plane view thereof, and FIG. 1*c* is a section taken along a line 1*c*—1*c* in FIG. 1*b;*

FIGS. 3*a* and 3*b* are partly cutaway perspective views of agitator blades which have a set of two local agitators on a surface of a mounting frame, wherein FIG. 3*a* shows an agitator blade having two local agitators on both surfaces of the mounting frame, and FIG. 3*b* shows another agitator blade having two local agitators on one surface of the mounting frame;

FIGS. 7*a* through 7*c* show a modification of the agitator blade of this invention, wherein FIG. 7*a* is a horizontal cross section of a local agitator, FIG. 7*b* is a front view of the local agitator with a side wall of the square cylinder removed, and FIG. 7*c* is a perspective view of bent plates built into the cylinder of the local agitator;

FIGS. 9*a* and 9*b* illustrate a local agitator incorporating three bent plates in a rectangular cylinder, that are each bent five times, wherein FIG. 9*a* represents a horizontal cross section of the local agitator and FIG. 9*b* represents a front view of the local agitator with a side wall of the rectangular cylinder removed;

FIGS. 10*a* through 10*c* show a local agitator incorporating two flat plates in a rectangular cylinder, wherein FIG. 10*a* represents a partly cutaway perspective view of the local agitator, FIG. 10*b* represents a vertical cross section of the local agitator, and FIG. 10*c* represents a plane view of the local agitator with the upper surface of the rectangular cylinder removed;

DETAILED DESCRIPTION OF EMBODIMENTS

The present invention will be described in detail in conjunction with embodiments shown in the accompanying drawings. It is noted, however, that the invention is not limited to these embodiments alone.

Figure 1A:
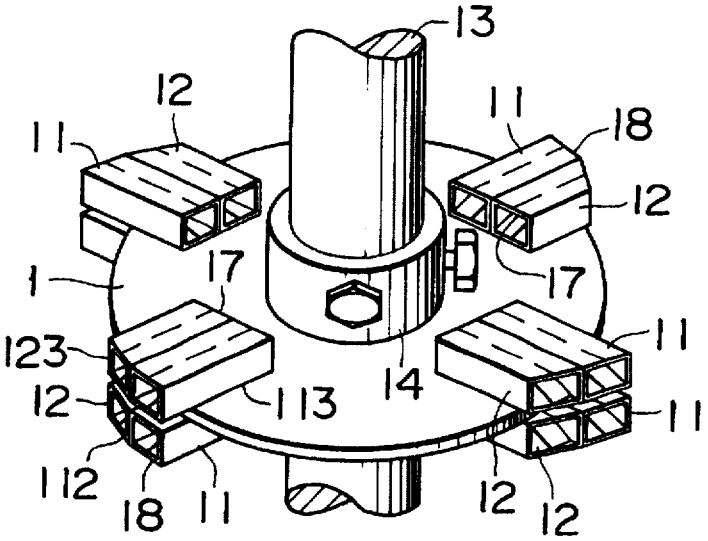
Figure 1B:
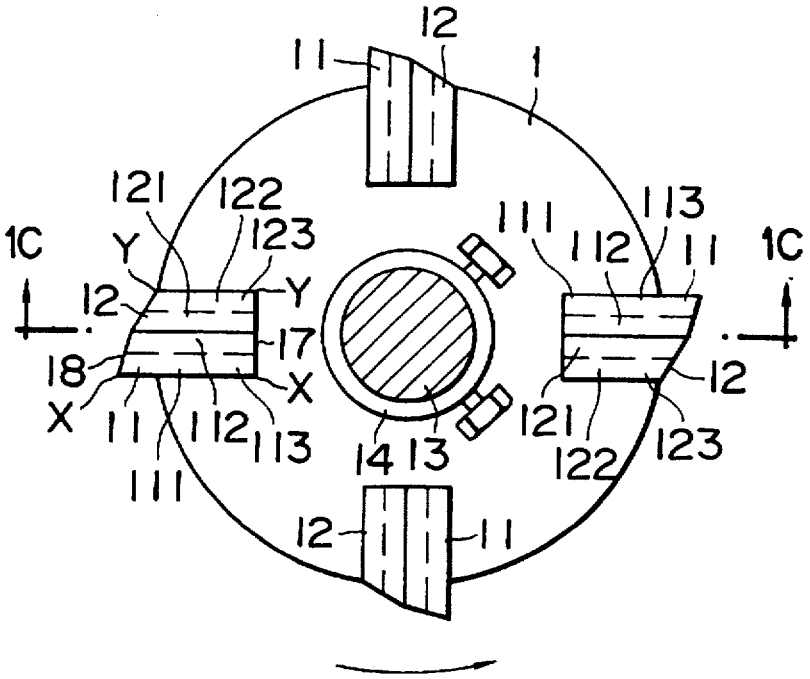
Figure 1C:
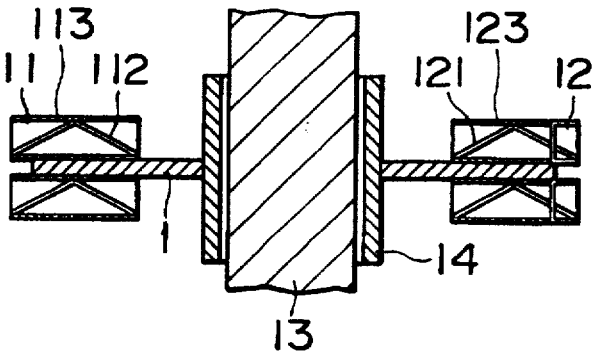

FIGS. 1*a* to 1*c* show an embodiment of an agitator blade of the present invention, which has local agitators mounted on a disk-shaped mounting frame secured to an agitator shaft. FIG. 1*a* is its perspective view, FIG. 1*b* is a plane view and FIG. 1*c* is a section taken along a line 1*c*—1*c* in FIG. 1*b*. The agitator blade comprises four sets of radially arranged local agitators at the periphery of each of both surfaces of the mounting frame 1, each set being composed of two local agitators 11, 12. The four sets of local agitators are spaced apart one another by a center angle of 90 degrees. The local agitators 11 and 12 which compose a set of local agitators are arranged parallelly in rotating direction and in contact with each other to form an integral assembly.

An agitator shaft 13 is inserted into a central opening formed at the center of the disk-shaped mounting frame 1, and secured to a boss 14 by screws for fixing it to the mounting frame 1.

The local agitators 11, 12 are composed of rectangular cylinders 113 and 123, respectively, which incorporate therein bent plates 111, 112 and 121, 122 which are assembled in reverse relationship with each other to form inner fabrics. The peripheries of bent plates 111, 112 or 121, 122 are brought into contact with each other.

Each of the rectangular cylinders 113, 123 of the local agitators 11, 12 has an inner axial end 17 which is a plane perpendicular to the longitudinal axis, and an outer axial end 18 which is a plane inclined in relation to the longitudinal axis of the cylinder. Herein, the former is called as 'the first axial end', and the latter is called as 'the second axial end'. The first axial end is an end located closer to the agitator shaft 13, and the second axial end is an end located more remote from the agitator shaft 13. Each of the cylinders 113 and 123 is opened at its first and second axial ends on a rotating plane or the mounting frame.

Each of the first axial end 17 and the second axial end 18 has a leading edge X and a trailing edge Y, in relation to the direction of rotation.

The radial distance from the leading edge X of the second axial end 18 to the agitator shaft is greater than the radial distance from the trailing edge Y to the agitator shaft.

The first axial ends 17 of the local agitators 11, 12 form in a plane substantially perpendicular to the longitudinal axes of the agitators. Details of the local agitators 11, 12 will be further mentioned hereinafter referring to FIGS. 7*a* and 7*b*.

The agitator shaft 13 is connected to an electric motor (not shown). When the local agitators 11, 12 of the agitator blade are immersed in liquid, the agitator shaft 13 is rotated in the direction that the edge X of the second axial end 18 becomes the leading edge. Liquid is supplied from the opening of the first axial end 17 into the local agitators 11, 12, and efficiently agitated and mixed by creating a complicated flow passage in the rectangular cylinders 113, 123 by the action of the inner fabrics (sets of bent plates) incorporated in the cylinders, and finally discharged from the opening of the second axial end 18 of the local agitators 11, 12.

FIGS. 2*a* to 2*d* are partial cutaway planes of modifications of agitator blades of this invention, in which several arrangements of a local agitator(s) is shown.

Figure 2A:
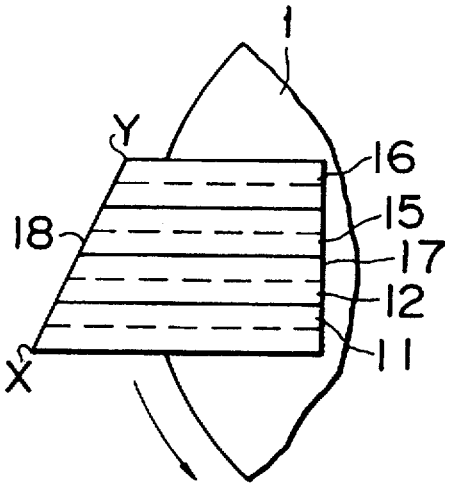
FIGS. 2*a* through 2*d* are enlarged partly cutaway plane views of various agitator blades, wherein local agitator are differently arranged.
Figure 2B:
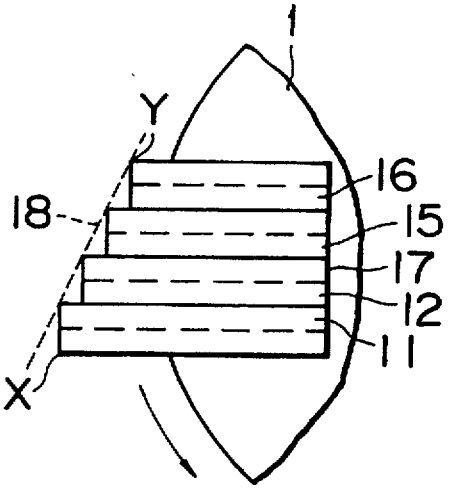
Figure 2C:
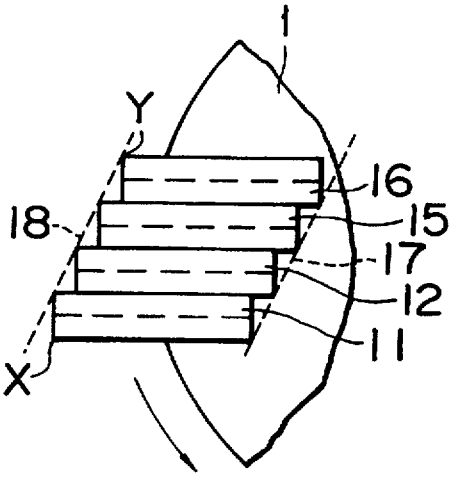

In FIGS. 2*a* to 2*c*, four local agitators 11, 12, 15 and 16 are fixed on one surface of a mounting frame 1 to form a set of local agitators which are arranged in contact one another and parallelly in the direction of rotation.

In an agitator blade shown in FIG. 2*a*, four local agitators 11, 12, 15 and 16 are oblique to the radius of the rotating plane as a whole at outer ends of their openings, to form the second axial end 18. The openings of the local agitators are gradually set back, as the local agitator becomes rear in the direction of rotation (counterclockwise in FIG. 2*a*). Accordingly, the radial distance from the leading edge X to an agitator shaft (not shown) is greater than the radial distance from the trailing edge Y to the agitator shaft. Also, the edges of the inner openings of four local agitators 11, 12, 15 and 16 are uniformly cut perpendicularly to the radius of the rotating plane.

In an agitator blade shown in FIG. 2*b*, both openings of each of four local agitators 11, 12, 15 and 16 are perpendicular to the longitudinal axis of the local agitator. The outer openings of the local agitators are arranged stepwise in a line obliquely drawn to the radius of the rotating plane to form the second axial end 18. Other features are not materially altered from those mentioned referring to the agitator blade shown in FIG. 2*a*.

In an agitator blade shown in FIG. 2*c*, length of four local agitators 11, 12, 15 and 16 are substantially equal with each other, and the edges of the inner openings of the local agitators are arranged stepwise in a line obliquely drawn to the radius of the rotating plane to form the first axial end 17, for gradually setting back as a local agitator becomes rear. Other features are not materially altered from those mentioned referring to the agitator blade shown in FIG. 2*a*.

Figure 2D:
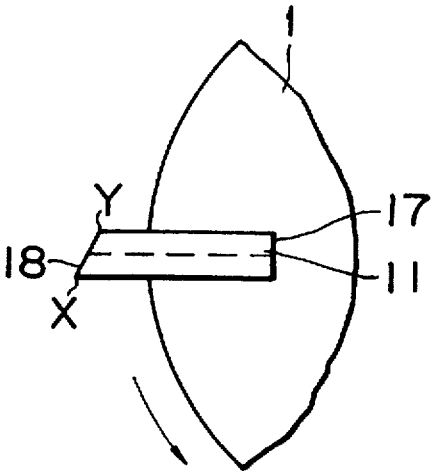

An agitator blade shown in FIG. 2*d* has one local agitator 11 whose second axial end 18 (an edge of an outer opening of a rectangular cylinder) is oblique to set back its rear part, and whose first axial end 17 is perpendicular to the radius of the rotating plane. The local agitator is fixed on a disk-shaped mounting frame.

As to the construction of local agitators of the agitator blades shown in FIGS. 2*a* to 2*d*, there is no substantial difference from those of the local agitators shown in FIGS. 1*a* to 1*c*.

In FIGS. 1*a* to 2*d*, a broken line shown in the center of each local agitator shows a boundary plane of two bent plates.

Figure 3A:
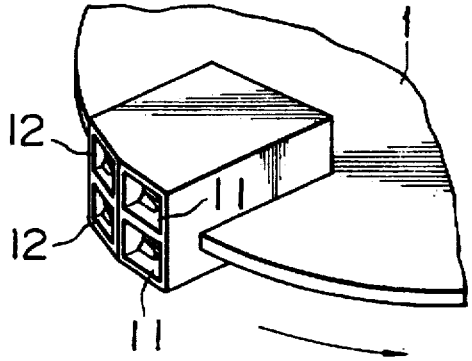
Figure 3B:
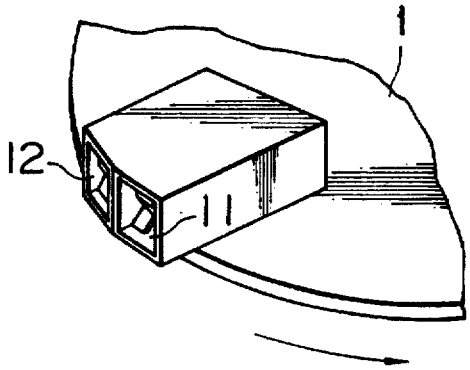

FIGS. 3*a* and 3*b* is a partial cutaway perspective view of further modifications of this invention. In FIG. 3*a*, there is shown an agitator blade in which two sets of local agitators 11, 12 are stacked together, and arranged on both surfaces of a disk-shaped mounting frame 1. In FIG. 3*b*, there is shown another agitator blade in which one set of local agitators 11, 12 are arranged on one surface of a disk-shaped mounting frame 1. Other features are not materially altered from those mentioned referring to the agitator blade shown in FIGS. 1*a* to 1*c*.

Figure 4A:
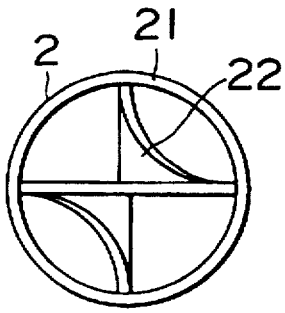
FIGS. 4*a* and 4*b* are a side view and a vertical cross section, respectively, of a local agitator which incorporates two twisted plates that are twisted in a positive or forward direction at a twist angle of 90 degrees in a cylinder.
Figure 4B:
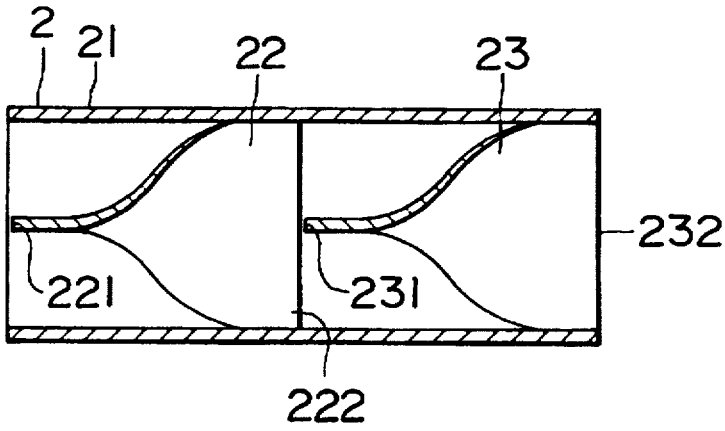

A local agitator 2 shown in FIGS. 4*a* and 4*b* has two twisted plates 22, 23 installed inside a cylinder 21 with their peripheries in contact with the inner circumferential surface of the cylinder 21.

A twisted plate 22 is made by twisting a rectangular plate—whose shorter peripheral side and longer peripheral side are substantially equal to the inner diameter and one-half the length, respectively, of the cylinder 21—in a positive or forward direction so that the short peripheral side 221 at one end and the short peripheral side 222 at the other end are nearly at right angles. The twisted plate 23 is also formed in the similar way. These twisted plates 22, 23 are installed inside the cylinder 21 with the facing short peripheral sides 222, 231 set approximately 90 degrees from each other, with the axes of the two twisted plates virtually aligned, and with the two twisted plates arranged in series, end-to-end, in the direction of axis of the cylinder 21 and inscribed in the inner circumferential surface of the cylinder 21. These twisted plates 22, 23 form a complex flow passage in the cylinder 21 of the local agitator 2.

As the agitator shaft is rotated to drive the local agitators, the fluid to be mixed is drawn from one opening of the cylinder 21 (for example, left-side opening in FIG. 4*b*) into the cylinder 21 in which they are forced to pass through the complex flow passage before being discharged from the other opening.

Figure 5A:
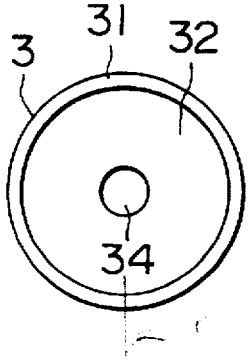
FIGS. 5*a* and 5*b* are a side view and a vertical cross section, respectively, of a local agitator incorporating two orifice plates in a cylinder.
Figure 5B:
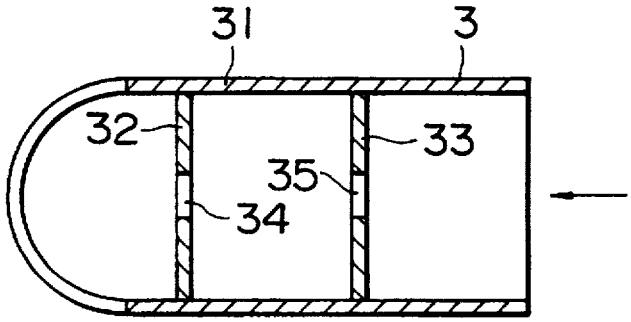

A local agitator 3 shown in FIGS. 5*a* and 5*b* has two orifice plates 32, 33 which are parallelly disposed inside the cylinder 31 in contact with the inner circumferential surface of the cylinder 31. These orifice plates 32, 33 have circular holes 34, 35 formed at their centers.

One end of the cylinder 31 (for example, left end in FIG. 5*b*) is oblique to the longitudinal axis of the cylinder 31, and the other end is perpendicular to the longitudinal axis.

The fluid to be mixed is forced into the cylinder 31 from the perpendicular opening (a right-side opening in FIG. 5*b*), pass through the holes 34, 35 at the centers of the orifice plates 32, 33 and are discharged from the other opening of the cylinder 31. The direction of the flow of fluid is the same as that of other local agitators with obliquely oriented axial ends mentioned hereinafter.

Figure 6A:
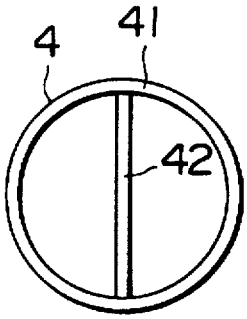
FIGS. 6*a* and 6*b* are a side view and a vertical cross section, respectively, of a local agitator incorporating in its cylinder two twisted plates that are twisted in opposite directions at a twist angle of 180 degrees, the vertical cross section showing only the cylinder in vertical cross section with the two twisted plates shown in the side view.
Figure 6B:
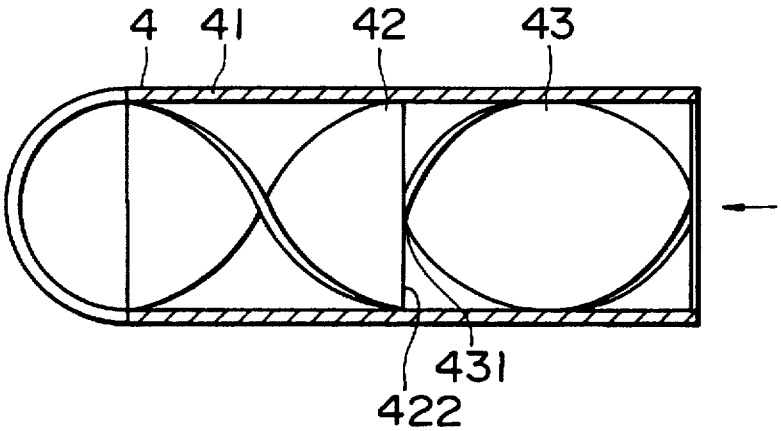

A local agitator 4 shown in FIGS. 6*a* and 6*b* has twisted plates 42, 43 inscribed in the cylinder 41. These twisted plates 42, 43 are arranged in series along the axis of the cylinder 41 and in contact, end-to-end, with each other, with the facing short peripheral sides 422, 431 set at approximately 90 degrees from each other. The two twisted plates 42, 43 are essentially similar to those used in the local agitator 2 of FIGS. 4*a* and 4*b*, except that they are twisted in opposite directions at the twist angle of 180 degrees.

A cylinder 41 has one axial end which is oblique to its longitudinal axis, and other axial end which is perpendicular to the longitudinal axis, similar to the cylinder 31 of the local agitator 3 shown in FIGS. 5*a* and 5*b*.

Figure 7A:
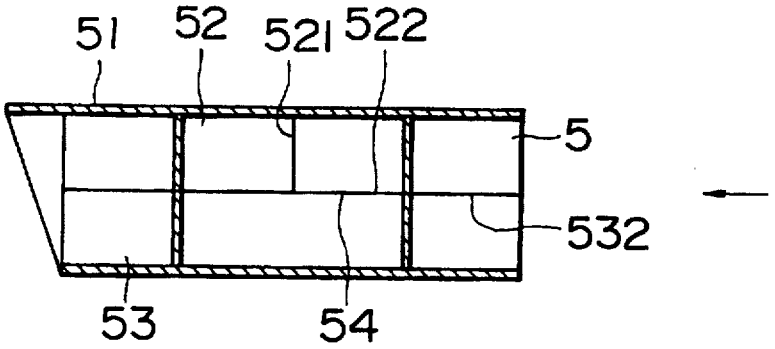
Figure 7B:
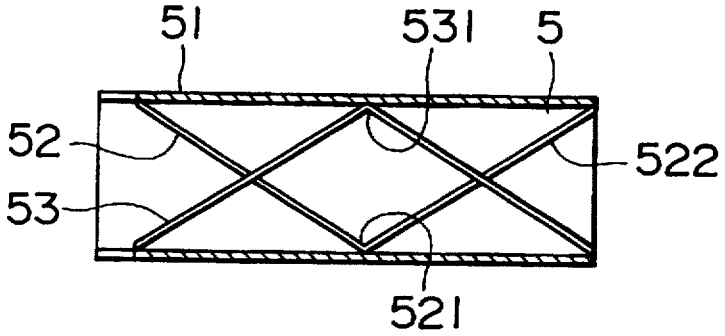
Figure 7C:
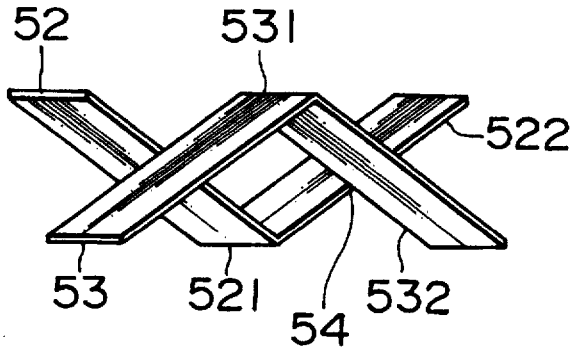

The local agitator 5 shown in FIGS. 7*a* and 7*b* has two bent plates 52, 53 shown in FIG. 7*c* installed in a rectangular cylinder 51 whose opening is rectangular. The bent plates 52, 53 are formed by bending rectangular flat plates along bending lines 521, 531. These two bent plates 52, 53 have their facing peripheral sides 522, 532 in contact with each other on a boundary plane 54 and are disposed in an inverted relationship with each other. They are installed in the rectangular cylinder 51 so that the cylinder 51 circumscribes them. The two bent plates 52, 53 are placed side by side with their axes virtually parallel to the axis of the rectangular cylinder 51.

Also, the cylinder 51 has one axial end (the second axial end) which is oblique to the rotation radius when the bending lines 521, 531 of each of the bent plates 52, 53 are made parallel to the rotating plane, and the other axial end (the first axial end) which is perpendicular to the rotation radius.

These bent plates 52, 53 form a complex flow passage inside the rectangular cylinder 51 of the local agitator.

The local agitator 5 is radially arranged to the mounting frame, an oblique axial end being made the outer axial end, that is, the second axial end.

As the local agitators 5 are driven by rotating the agitator shaft in the direction that an acute edge side thereof becomes the leading side, the fluid to be mixed is forced into the rectangular cylinder 51 from the first axial end-opening (an opening near to the agitator shaft), flow through a complicated passage formed in the cylinder 51, and then are forced out from the second axial end-opening (an opening remote from the agitator shaft) of the cylinder 51.

Figure 8:
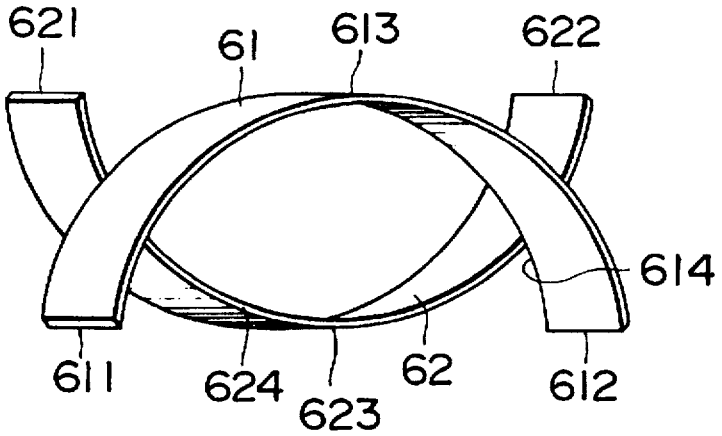
FIG. 8 is a perspective view of the bent plates to be incorporated in the square cylinder of the local agitator.

A bent plate 61 shown in FIG. 8 is curved to cause the opposite short peripheral sides 611, 612 of a rectangular plate to come near each other with the central portion raised as a vertex 613. Another bent plate 62 is also curved in the similar manner. These two bent plates 61 and 62 are disposed side by side in an inverted relationship so that the vertex 613 and a bottom 623 project in opposite directions. These bent plates are placed inside the rectangular cylinder with their facing long peripheral sides 614 and 624 in contact.

Figure 9A:
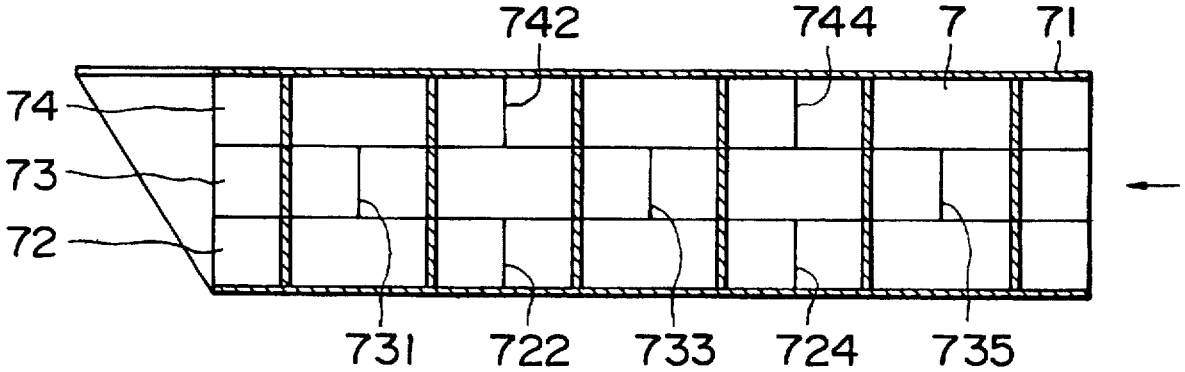
Figure 9B:
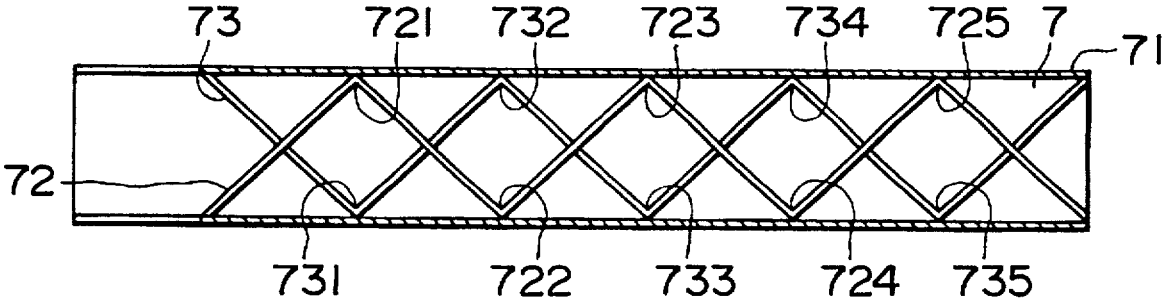

A local agitator 7 shown in FIGS. 9*a* and 9*b* has three bent plates 72, 73 and 74, each of which is bent five times and incorporated in a rectangular cylinder 71.

A bent plate 72 is formed of a rectangular plate bent along bending lines 721, 722, 723, 724 and 725. A second bent plate 73 is also a rectangular plate bent along bending lines 731, 732, 733, 734 and 735. The third bent plate 74 is also a rectangular plate, which is likewise bent along bending lines 741, 742, 743, 744 and 745. In other respects, these three bent plates are essentially the same as those shown in FIGS. 7*a* through 7*c*.

Further, the local agitator 7 has one axial end which is oblique to its longitudinal axis, and other axial end which is perpendicular to the longitudinal axis, similar to the local agitator 5 shown in FIGS. 7*a* and 7*b*.

Three bent plates 72, 73 and 74 are disposed in an inverted relationship one another, and incorporated in the cylinder 71, similar to those in the local agitator 5 shown in FIGS. 7*a* and 7*b*.

Figure 10A:
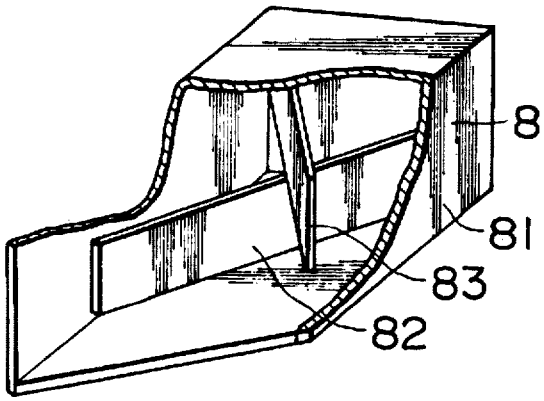
Figure 10B:
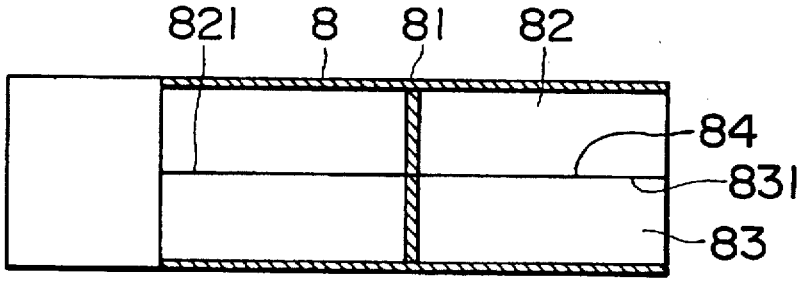
Figure 10C:
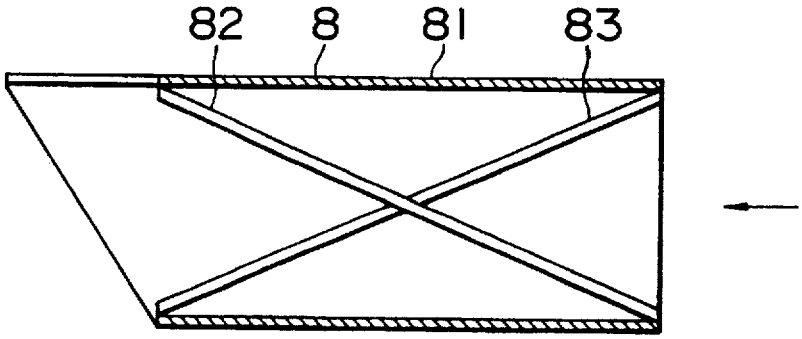

A local agitator 8 shown in FIGS. 10*a* through 10*c* contains two rectangular plates 82 and 83 in a rectangular cylinder 81. The flat and rectangular plates are stacked on their long peripheral sides so that they cross each other with their long peripheral sides 821, 831 in contact at the central portion. They are installed in a rectangular cylinder 81 so that the cylinder circumscribes them. A boundary plane 84 containing the long peripheral sides 821, 831 is parallel to the rotating plane of the local agitator 8. In other respects, this local agitator 8 is essentially similar to that shown in FIGS. 7*a* and 7*b*.

Figure 11:
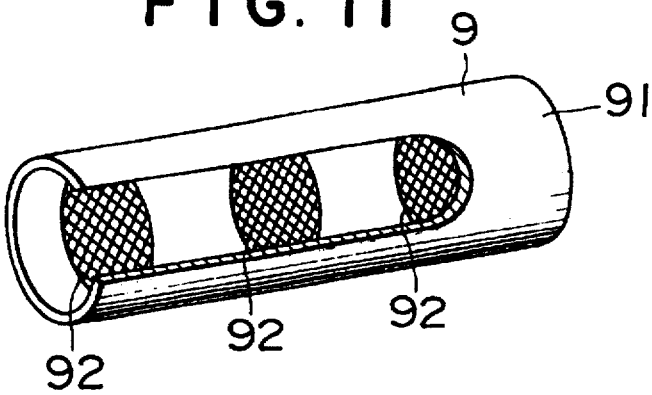
FIG. 11 is a partly cutaway perspective view of a local agitator incorporating in its cylinder a plurality of disk-shaped nets crossing the axis of the cylinder.

A local agitator 9 shown in FIG. 11 incorporates in its cylinder 91 a plurality of three disk-shaped nets 92, 92 and 92 so disposed as to cross the axis of the cylinder 91.

Figure 12:
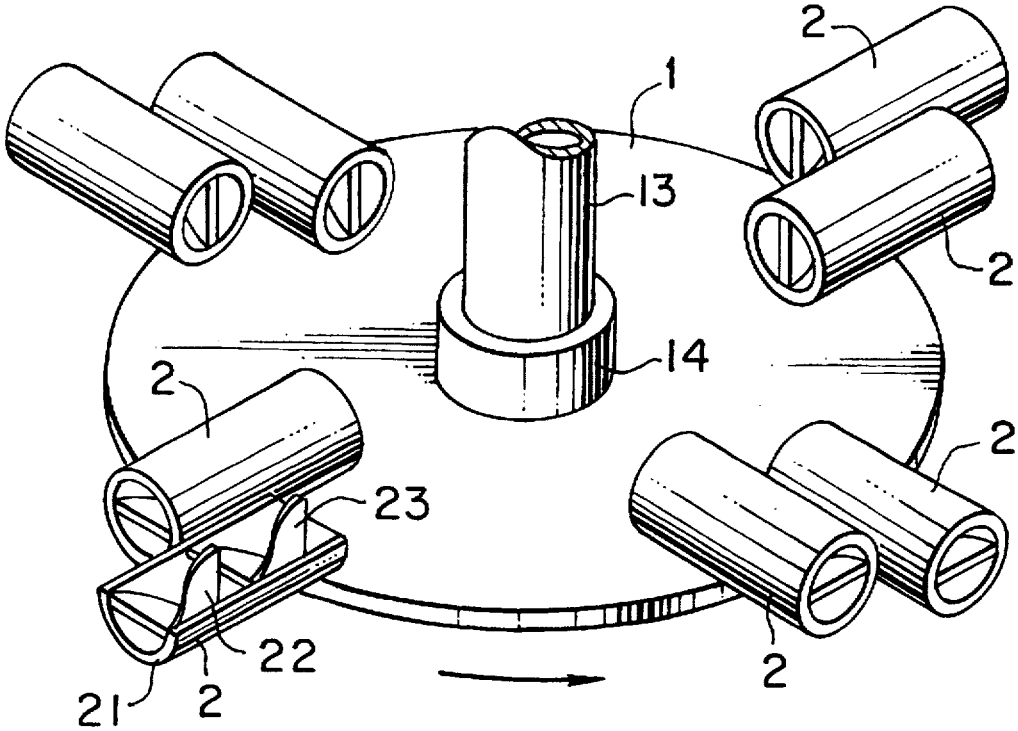
FIGS. 12 through 14 are perspective views of various agitator blades in which the aforementioned local agitators are mounted on a disk-shaped mounting frame.
Figure 13:
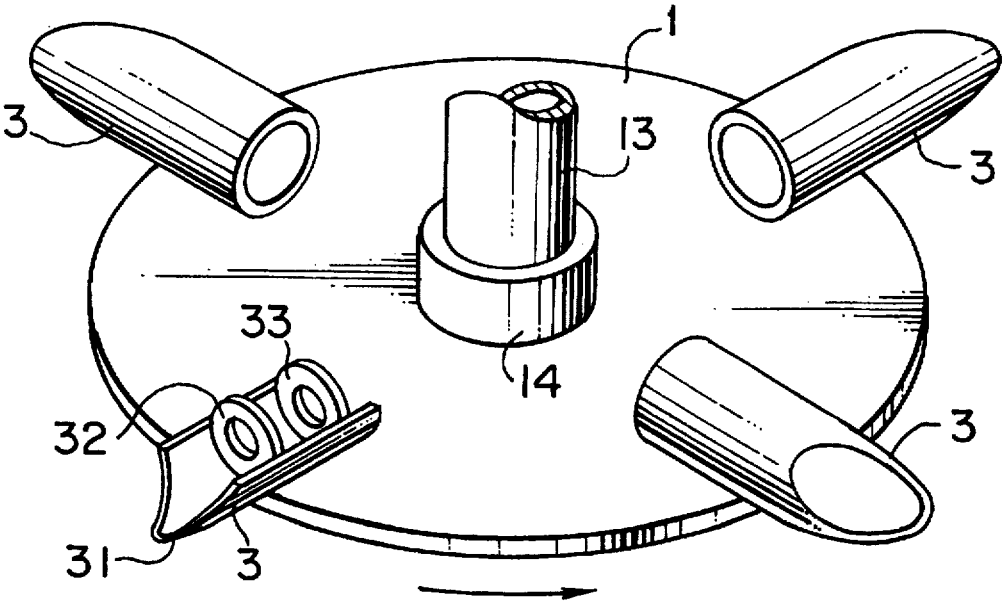
Figure 14:
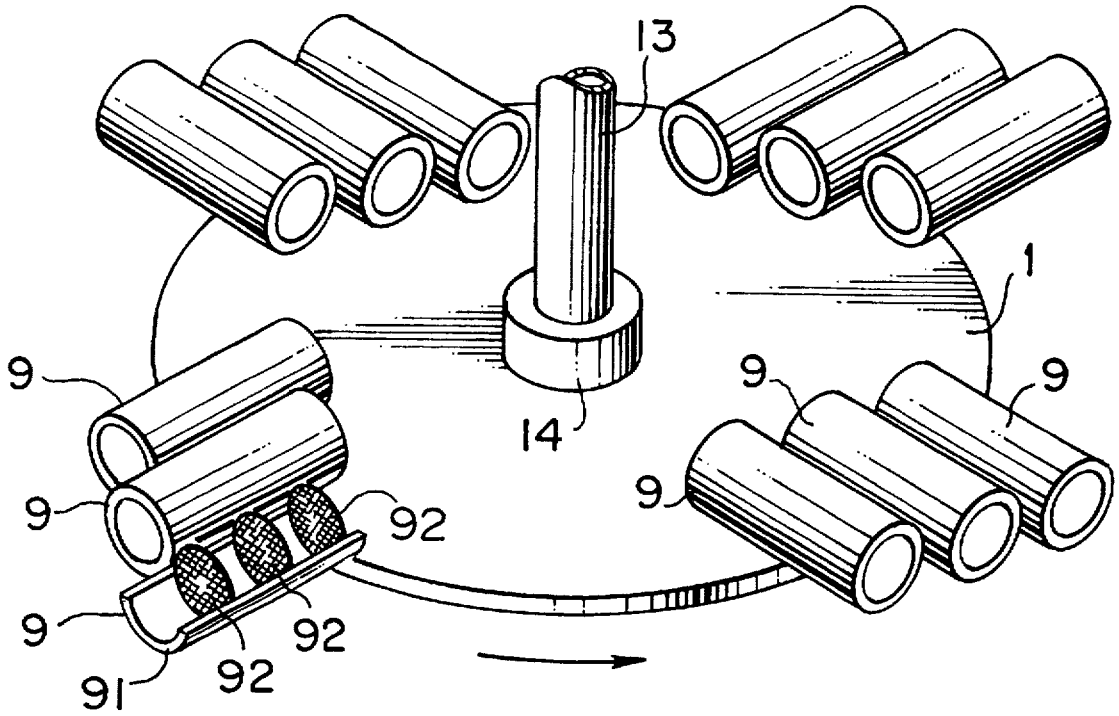

Agitator blades shown in FIGS. 12 through 14 are essentially similar to those shown in FIGS. 1*a* through 1*c*, except that they use the local agitators shown in FIGS. 4*a* through 5*b* and 11.

In FIGS. 12 through 14, one of the local agitators is shown in an axially cutaway condition. An agitator blade shown in FIG. 12 has four sets of local agitators 2 and 2, two of which local agitators are assembled as a set, and arranged radially with center angle of 90 degrees on the surface of a disk-shaped mounting frame 1. A set of local agitators 2 and 2 have longitudinal axes arranged parallel to each other, and their length are equal to each other. The outer edge of the local agitator 2 leading in the rotating direction is arranged more remote from the agitator shaft 13 than that of the outer edge of the trailing local agitator 2. As a result, the second axial end, which is a line connecting the outer edges of two local agitators 2, 2, is inclined so that the radial distance from its leading edge to the agitator shaft is greater than the radial distance from its trailing edge to the agitator shaft.

An agitator blade shown in FIG. 13 has four local agitators 3, 3, 3 and 3 which are radially disposed with the center angle of 90 degrees on the surface of the disk-shaped mounting frame 1. Each of the local agitators has the same shape as that shown in FIGS. 5*a* and 5*b*.

The local agitator 3 has an outer end which is obliquely cut, and arranged to lead the acute edge thereof in the rotating direction.

Thus, the inclined end surface amounts to the second axial end, and its acute edge amounts to the leading edge.

An agitator blade shown in FIG. 14 is essentially similar to those shown in FIG. 12, except that it uses four sets of three local agitators 9, 9 and 9 shown in FIG. 10, in lieu of the four sets of two local agitators 2 and 2.

Figure 15:
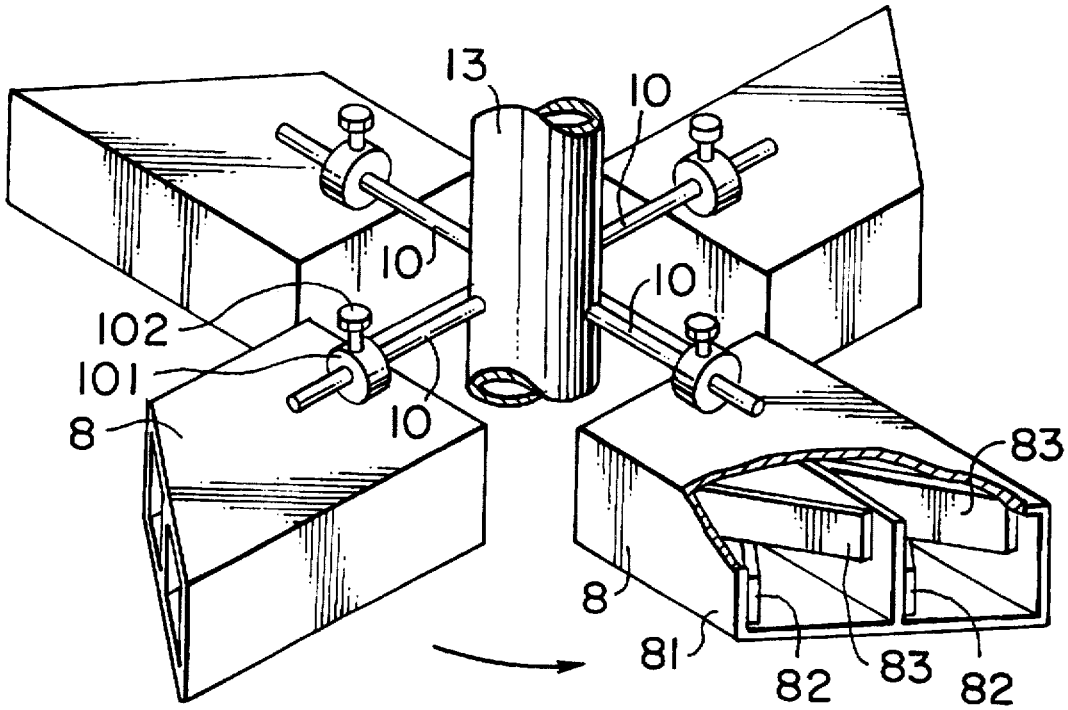
FIG. 15 is a perspective view of an agitator blade which has local agitators slidably mounted on rod-shaped mounting frames.

An agitator blade shown in FIG. 15 has four local agitator assemblies on four rod-shaped mounting frames 10, 10, 10 and 10 which are radially fixed with the center angle of 90 degrees to an agitator shaft 13. The local agitator assembly is composed of two local agitators 8 and 8, each being shown in FIGS. 10*a* through 10*c*. The two local agitators 8, 8 are literally connected so that flat plates 82 and 83 incorporated therein become vertical to the rotating plane and their longitudinal axes become parallel to each other. Side walls of two neighboring local agitators merges together to form a single partition.

Also, outer axial ends of cylinders 81 and 81 form an obliquely oriented face so that they form an inclined line to the radius of the rotating plane. As a result, the outer edges of the cylinders 81 and 81 amount to the second axial end which is inclined to the radius of the rotating plane. Also, the acute edge of the second axial end amounts to the leading edge.

On a common upper surface of the cylinders 81 and 81, there is fixed a ring 101, into which a rod-shaped mounting frame 10 is inserted, and secured by a screw 102 to the mounting frame 10, thereby fixing the agitators to the mounting frame 10. Accordingly, the local agitators are slidably mounted on the rod-shaped mounting frame 10 for allowing their adjustment in the radial direction.

What is claimed is:

1. An agitator blade comprising:

(1) a disk shaped mounting frame having opposing sides secured to a rotable agitator shaft, (2) at least one local agitator having a cylinder mounted one of said sides of said mounting frame, (3) said at least one local agitator containing inner fabrics in its cylinder, (4) said at least one local agitator being arranged radially in relation to said agitator shaft, (5) said at least one local agitator having first and second axial ends, (6) the first and second ends both open with respect to said mounting frame and spaced from said agitator shaft, (7) said at least one local agitator having the first axial end disposed closer to the agitator shaft and the second axial end disposed more remote from the agitator shaft, (8) each of the first and second axial ends having a leading edge and a trailing edge in relation to the direction of rotation, and (9) the radial distance from said leading edge of the second axial end to said agitator shaft being greater than the radial distance from said trailing edge of the second axial end to said agitator shaft.

2. An agitator blade as claimed in claim 1, wherein said at least one local agitator is slidably secured to said mounting frame.

3. An agitator blade as claimed in claim 1, wherein said cylinder of said at least one local agitator is a circular cylinder.

4. An agitator blade as claimed in claim 1, wherein said cylinder of said at least one local agitator is a rectangular cylinder.

5. An agitator blade as claimed in claim 1, wherein said inner fabrics of said at least one local agitator are composed of at least one twisted plate.

6. An agitator blade as claimed in claim 1, wherein said inner fabrics of said at least one local agitator are composed of at least one orifice plate.

7. An agitator blade as claimed in claim 1, wherein said inner fabrics of said at least one local agitator are composed of a plurality of bent plates which are disposed in an alternately inverted relationship with one another so that a pair of facing bent peripheral sides of a pair of adjacent bent plates cross each other.

8. An agitator blade as claimed in claim 1, wherein said inner fabrics of said at least one local agitator are composed of a plurality of flat plates which are stacked on the peripheral sides thereof so that a pair of facing peripheral sides of a pair of adjacent flat plates cross each other.

9. An agitator blade as claimed in claim 1, wherein said inner fabrics of said at least one local agitator are composed of at least one net-like sheet so disposed as to cross a longitudinal axis of said cylinder.

* * * * *